US009566697B2

(12) United States Patent
Furuie

(10) Patent No.: US 9,566,697 B2
(45) Date of Patent: Feb. 14, 2017

(54) TORQUE WRENCH

(71) Applicant: HONDA MOTOR CO., LTD., Tokyo (JP)

(72) Inventor: Kou Furuie, Tokyo (JP)

(73) Assignee: HONDA MOTOR CO., LTD., Tokyo (JP)

( * ) Notice: Subject to any disclaimer, the term of this patent is extended or adjusted under 35 U.S.C. 154(b) by 321 days.

(21) Appl. No.: 14/374,016

(22) PCT Filed: Sep. 27, 2012

(86) PCT No.: PCT/JP2012/074898
§ 371 (c)(1),
(2) Date: Jul. 23, 2014

(87) PCT Pub. No.: WO2013/111386
PCT Pub. Date: Aug. 1, 2013

(65) Prior Publication Data

US 2014/0373690 A1 Dec. 25, 2014

(30) Foreign Application Priority Data

Jan. 25, 2012 (JP) ..... 2012-013059

(51) Int. Cl.
*B25B 23/14* (2006.01)
*B25B 23/142* (2006.01)

(52) U.S. Cl.
CPC ..... *B25B 23/14* (2013.01); *B25B 23/1422* (2013.01); *B25B 23/1425* (2013.01)

(58) Field of Classification Search
CPC ... B25B 23/14; B25B 23/1422; B25B 23/1425
See application file for complete search history.

(56) References Cited

U.S. PATENT DOCUMENTS 7,984,657 B2 * 7/2011 DeRose ..... B25B 21/00 73/862.22
9,229,232 B2 * 1/2016 Backhaus ..... B25B 23/1425 345/8

(Continued)

FOREIGN PATENT DOCUMENTS

| | | |
|---|---|---|
| JP | 2005-121132 | 5/2005 |
| JP | 2009-248199 | 10/2009 |
| JP | 2010-042491 | 2/2010 |

OTHER PUBLICATIONS

International Search Report, Date of mailing: Nov. 13, 2012 (Nov. 13, 2012).

*Primary Examiner* — David B Thomas
(74) *Attorney, Agent, or Firm* — Rankin, Hill & Clark LLP

(57) ABSTRACT

A top surface of a transmitter on a torque wrench is opposed to a position camera, and bolt holes to fix the transmitter to a wrench main body open on the top surface. The bolt holes are formed to four places so as to define a rectangle and extend in a thickness direction of the transmitter. The marker is attached to the top surface of a head of one of the bolts, which extends through a through bolt hole. When the transmitter is fixed to the main body using a bolt, the depth of a large diameter portion of the through bolt hole is larger than the total thickness of the bolt head portion and the marker. Therefore, the marker is disposed lower than an aperture surface of the bolt hole and the possibility of the marker being damaged during work is reduced.

15 Claims, 1 Drawing Sheet

(56) References Cited

U.S. PATENT DOCUMENTS

| | | | | |
|---|---|---|---|---|
| 2012/0167721 | A1* | 7/2012 | Fluhrer | B25B 21/00 81/54 |
| 2013/0032369 | A1* | 2/2013 | Dridger | B25B 21/00 173/2 |
| 2014/0009305 | A1* | 1/2014 | Schultz | B25B 23/14 340/870.01 |
| 2014/0139406 | A1* | 5/2014 | Backhaus | B25B 23/1425 345/8 |
| 2015/0247745 | A1* | 9/2015 | McClogan | B25B 23/1425 702/33 |

* cited by examiner

TORQUE WRENCH

FIELD OF THE INVENTION

This invention relates to a torque wrench which tightens a screw and a bolt with a uniformity of power, in particular, a torque wrench which is provided with a marker which can determine position.

BACKGROUND ART

Because a torque wrench can tighten parts with a predetermined clamping power (tension force), torque wrenches are used conventionally when attaching parts to a vehicle body.

However, as some of the parts are fixed using a large number of bolts, it is hard to distinguish a bolt which is loosely tightened and a bolt which is strongly tightened at a glance, therefore, it is possible that the tightening of some bolts may be overlooked.

To resolve such a problem, Patent Document 1 and Patent Document 2 are suggested.

Patent Document 1 discloses a means to prevent tightening from being forgotten, that is, attach a light emitting device which emits light when clamping has been completed by a torque wrench, this emission of light is detected by a camera, and the position of the bolt on which clamping has been completed by the torque wrench is memorized by a computer.

Patent Document 2 discloses a means to prevent tightening from being forgotten, that is, attach a supersonic wave oscillator to the head of the torque wrench, receive the pulse from the supersonic wave oscillator by 3 receiving antennas, and calculate the position of the bolt on which clamping has been completed using the principle of triangle range-finding, then store the calculated value in a computer.

A LED is used as the light emitting device which emits light when clamping is completed, but if the LED is exposed on the outside, it might be damaged in cases when the torque wrench fell.

Therein, Patent Document 3 suggests the LED be put in a case which has holes, or to provide a light guide leading LED light to the surface of the case.

PRIOR ART

Patent Document

[Patent Document 1] Japanese Laid Open Patent 2010-042491

[Patent Document 2] Japanese Laid Open Patent 2005-121132

[Patent Document 3] Japanese Laid Open Patent 2009-248199

DISCLOSURE OF INVENTION

Problems Solved by the Invention

The LED disclosed in Patent Document 3 is not a marker to detect the position of the torque wrench, but it is conceivable to apply the LED as the marker disclosed in Patent Document 1 or 2.

However, in this circumstance, a hole or light guide must be provided which can allow the light of the LED to be detected as the marker from within the case, and multiple marker pieces (more than three) are required to detect the position of the torque wrench precisely, additionally, the attaching of the marker to the part should avoid interfering with the work and should avoid being covered by the worker during the work.

Means For Solving Problems

In order to solve the above problem, a torque wrench of the present invention is characterized;

A plurality of points for accessories, such as an indicator or transmitter, are fastened by fasteners such as a bolt or screw to the main body of the wrench, the accessories have a plane imaged by a camera for position confirmation, the passage holes for the fastener open on the plane, in the condition when the accessories are fastened to the wrench the head of the fasteners fall below the plane surface of the aperture of the passage holes, and a marker for position confirmation is attached to the top surface of the head of the fastener.

As the position and the shape of the marker, for example, it is expected four places that are a rectangular corner.

Also, other than the marker of four places of above, it is conceivable to add two markers which determine the direction of the torque wrench.

There is not the limit in particular if it can photograph with a camera for a marker, so sheet or LED are expected.

Effects of the Invention

According to the torque wrench of the present invention, because the marker which determines the position is sunk into the through hole rather than being on the surface of the accessories, there is no fear of the marker being damaged or peeled off by hitting other members during work.

Also, forming an exclusive recess and sticking the marker in that recess takes effort.

However, according to the present invention, increased costs can be held down since through holes, such as for bolts, are used.

BEST MODE FOR CARRYING OUT THE INVENTION

Figure 1:
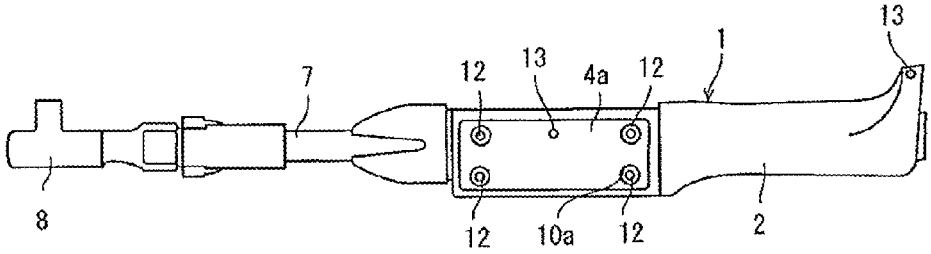
FIG. 1 Plane view of the torque wrench of the present invention.
Figure 2:
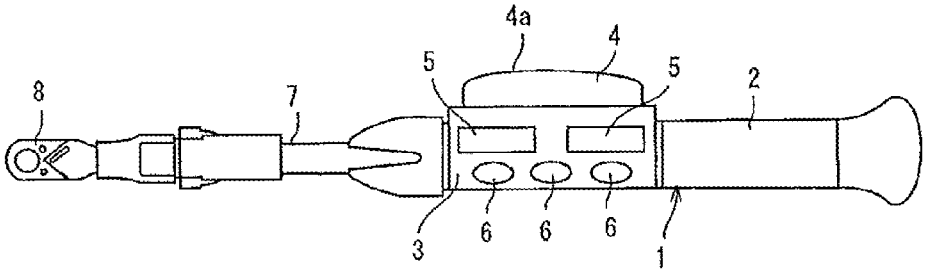
FIG. 2 Side view of the torque wrench of the present invention.

An embodiment of the present invention is explained below based on the attached drawing.

Part of the main body 1 of the torque wrench is a grip section 2 and an indicator 3 and a transmitter 4 is attached to other portions of the main body 1.

The indicator 3 is provided with an indication area 5 digitally indicating the clamping torque and switches 6, the transmitter 4 transmits the detected clamping torque value to a PC.

The main body 1 is provided with a lever 7, the tip of the lever 7 is provided with a head 8 comprising a toggle mechanism.

Figure 3:
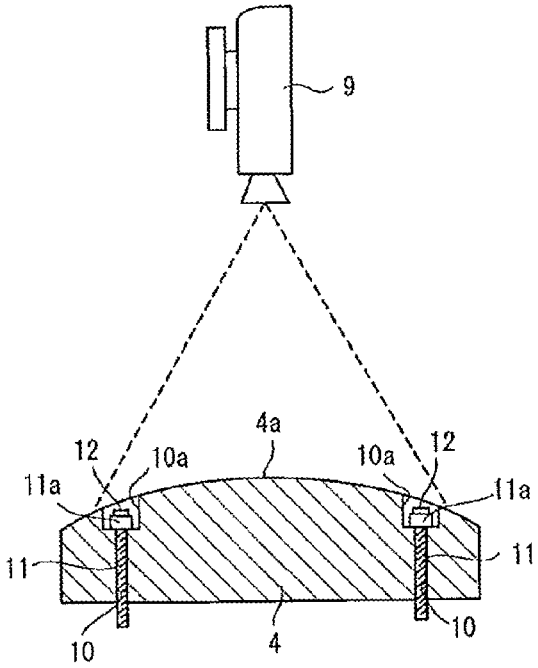
FIG. 3 Expanded sectional view of the essential part of the torque wrench of the present invention.

As shown in FIG. 3, the top surface 4*a* of the transmitter 4 on the torque wrench is opposed to a position camera 9, a bolt hole 10 to fix the transmitter 4 to the main body 1 is opened on the top surface 4*a*.

The bolt holes 10 are formed to four places in total, positioned at the rectangular corners when viewed from the direction of the camera 9, and the bolt holes 10 are formed in the thickness direction of the transmitter 4.

A marker 12 is attached to the top surface of the head 11*a* of a bolt 11 passed through bolt hole 10.

As for the attachment means, this is optional and can be stuck on or adsorbed with a magnet.

Also, in the condition where the transmitter 4 is fixed to the main body 1 using a bolt 11, the depth of the large diameter 10*a* (of the bolt through hole) is larger than that of the total thickness of the bolt head portion 11 a and the thickness of the marker 12.

As a result, the marker 12 is positioned to be lower than the aperture surface of the bolt hole 10.

The possibility of the marker being damaged or peeled off by hitting other members during work is therefore reduced.

In the above, confirm the position of the four markers 12 with the camera 9, input the position of the torque wrench, that is the position of the point in time when the signal of the clamping completion has been sent from the transmitter 4 by predetermined torque to the computer, and store/record that clamping has been completed for every individual fastener.

In the above examples, even if a total of four markers are attached, positioned at each rectangular corner, identification of the direction (right side or left side) of the torque wrench may not be possible.

Therein as shown in FIG. 1, another marker 13 may be added which is different from the above.

Regarding this marker 13, it is preferable to put the marker into an existing recess since it will be protected from possible damage

INDUSTRIAL APPLICABILITY

The torque wrench of the present invention can be used in the assembling process of an engine and the vehicle body of an automobile.

Explanations of the Letters and Numerals

1 . . . main body of torque wrench, 2 . . . grip section, 3 . . . indicator, 4 . . . transmitter, 4*a* . . . the top surface of the transmitter, 5 . . . indication area, 6 . . . switches, 7 . . . lever, 8 . . . head, 9 . . . camera, 10 . . . bolt through hole, 10*a* . . . large diameter of the bolt thorough hole, 11 . . . bolt, 11*a* . . . bolt head portion, 12,13 . . . marker.

The invention claimed is:

1. A torque wrench comprising:

a main body including a grip section and a lever having a lever head; and at least one accessory fastened by fasteners to the main body, wherein the at least one accessory has a plane imaged by an associated camera for position confirmation, and passage holes of the fasteners open on the plane, and wherein, when the at least one accessory is attached to the main body, a head of the fasteners fall below a plane surface of an aperture of the passage holes of the fasteners open on the plane, and a marker for position confirmation is attached to a top surface of the head of each of the fasteners.

2. The torque wrench according to claim 1, wherein the marker includes markers that are attached to four places that are at rectangular corners of the at least one accessory.

3. The torque wrench according to claim 2, where, in addition to the markers placed on the four rectangular corners of the at least one accessory, the marker further includes two markers added to determine a direction of the torque wrench.

4. The torque wrench according to claim 1, wherein the at least one accessory includes an indicator.

5. The torque wrench according to claim 4, wherein the marker includes markers that are attached to four places that are at rectangular corners of the at least one accessory.

6. The torque wrench according to claim 5, where, in addition to the markers placed on the four rectangular corners of the at least one accessory, the marker further includes two markers added to determine a direction of the torque wrench.

7. The torque wrench according to claim 1, wherein the at least one accessory includes a transmitter.

8. The torque wrench according to claim 7, wherein the marker includes markers that are attached to four places that are at rectangular corners of the at least one accessory.

9. The torque wrench according to claim 8, where, in addition to the markers placed on the four rectangular corners of the at least one accessory, the marker further includes two markers added to determine a direction of the torque wrench.

10. The torque wrench according to claim 1, wherein the fasteners comprise bolts.

11. The torque wrench according to claim 10, wherein the marker includes markers that are attached to four places that are at rectangular corners of the at least one accessory.

12. The torque wrench according to claim 11, where, in addition to the markers placed on the four rectangular corners of the at least one accessory, the marker further includes two markers added to determine a direction of the torque wrench.

13. The torque wrench according to claim 1, wherein the fasteners comprise screws.

14. The torque wrench according to claim 13, wherein the marker includes markers that are attached to four places that are at rectangular corners of the at least one accessory.

15. The torque wrench according to claim 14, where, in addition to the markers placed on the four rectangular corners of the at least one accessory, the marker further includes two markers added to determine a direction of the torque wrench.

* * * * *